United States Patent [19]

Hemphill

[11] 4,133,121

[45] Jan. 9, 1979

[54] BACKHOE BUCKET ADAPTER BUSHING AND PIN METHOD AND APPARATUS

[76] Inventor: Charles W. Hemphill, 1106 Green Valley La., Duncanville, Tex. 75116

[21] Appl. No.: 817,733

[22] Filed: Jul. 21, 1977

Related U.S. Application Data

[63] Continuation-in-part of Ser. No. 715,560, Aug. 18, 1976, Pat. No. 4,037,337.

[51] Int. Cl.[2] ..... E02F 3/00

[52] U.S. Cl. ..... 37/118 R; 214/138 R

[58] Field of Search ..... 37/118 R, 117.5, 103, 37/141 R, 141 T; 214/131 R, 131 A, 138 R, 145 A; 172/245, 250

[56] References Cited

U.S. PATENT DOCUMENTS

| | | | |
|---|---|---|---|
| 3,047,170 | 7/1962 | Hough et al. | 214/131 |
| 3,672,521 | 6/1972 | Bauer et al. | 214/145 A |
| 3,705,656 | 12/1972 | Hunger et al. | 214/145 A |
| 3,853,232 | 12/1974 | Oke et al. | 37/118 R |
| 3,964,622 | 6/1976 | Blair et al. | 37/117.5 |
| 4,023,288 | 5/1977 | Roe | 37/117.5 |
| 4,056,250 | 11/1977 | Uchiyama | 214/131 A X |

FOREIGN PATENT DOCUMENTS

| | | | |
|---|---|---|---|
| 2500217 | 1/1975 | Fed. Rep. of Germany | 37/118 R |
| 1365139 | 5/1964 | France | 37/118 |
| 715794 | 10/1966 | Italy | 214/131 A |
| 1210129 | 10/1970 | United Kingdom | 37/141 T |
| 1414185 | 10/1972 | United Kingdom | 37/117.5 |
| 306228 | 11/1971 | U.S.S.R. | 37/141 R |

*Primary Examiner*—E. H. Eickholt
*Attorney, Agent, or Firm*—Marcus L. Bates

[57] ABSTRACT

A lift adapter apparatus by which one of a plurality of digging buckets can be attached to one of a plurality of backhoe machines comprising an upper and lower bushing and pin assembly attached to spaced lifting ears located on the bucket. The bushings are attached to the ears and receive the pin therethrough so that the dipper receptacle and the curl cylinder receptacle can be attached in journaled relation to a medial length of the exposed upper and lower pins. The width of the bushings and the pin diameter can be selected to enable any one bucket to become operatively attached to any compatible size backhoe machine.

5 Claims, 8 Drawing Figures

BACKHOE BUCKET ADAPTER BUSHING AND PIN METHOD AND APPARATUS

REFERENCE TO RELATED APPLICATIONS

This patent application is a continuation in part of my previously filed patent application Ser. No. 715,560, filed Aug. 18, 1976, now U.S. Pat. No. 4,037,337, issued July 26, 1977.

BACKGROUND OF THE INVENTION

More than thirty different major manufacturers produce backhoe machines in the United States. Each manufacturer usually makes available to the consumer more than ten different models or sizes of backhoe machines. Each of the different models of the backhoe machines often incorporates a different size upper and lower receptacle by which the dipper stick and curl cylinder are attached to a bucket. Accordingly, when the industry is considered as a whole, there are a total of more than six hundred different combinations of attachment points provided on backhoe machines and consequently there must be six hundred different configurations of digging buckets in order that each one of the machines might have a digging bucket attached thereto. Where more than one type and size of bucket is required for any individual machine, the number of buckets which must be made available to the backhoe industry becomes unbelievably numerous.

When excavating in various different type strata of the earth, it is desirable for a backhoe machine to have made available various different type digging buckets so that proper selection can be made for the bucket most suitable for the specific type material being excavated. In order to accomplish this desirable attribute, it is necessary for the backhoe operator to keep several different backhoe buckets available for a specific backhoe machine so that he can select the particular bucket most suitable for the specific job at hand.

It is not unusual for a contractor's backhoe machine to become inoperative during the middle of a job, and the contractor consequently is forced to change to a different type of machine. The substituted machine invariably will be unable to use the contractor's assortment of buckets for the reason that the dipper stick or the curl cylinder receptacle will not match the lifting means provided by the bucket manufacturer on the contractor's bucket. Accordingly, it is almost essential that each different model and size of backhoe machine have its own supply of buckets.

Digging buckets for backhoe machines are extremely expensive and constitute a major investment for the dirt contractor. It would therefore be desirable to have made available a backhoe type bucket having a lift adapter apparatus incorporated therein which enables one of a plurality of buckets to be attached to one of a plurality of backhoe machines. This desirable expedient would enable several different type or size of machines to use one specific bucket, and would also enable several different buckets to be used in conjunction with a single backhoe machine, by merely selecting the proper lift adapter bushing and pin apparatus.

In particular, it would be desirable to have made available a minimum number of different size buckets made in accordance with the Hemphill U.S. Pat. No. 4,037,337 with there further being made available a lift adapter apparatus by which any one of the plurality of Hemphill buckets could be attached to any one of a plurality of different backhoe machines by merely changing part of the lift adapter apparatus associated therewith. The unforeseen and unexpected advantages resulting from such a desirable and unusual improvement is manifold, and would effect a tremendous savings in money, time, equipment, and energy.

SUMMARY OF THE INVENTION

This invention relates to excavating equipment and specifically to a lift adapter apparatus by which one of a plurality of buckets can be attached to one of a plurality of backhoe machines, comprising a bucket having lifting ears which receive upper and lower bushing and pin assemblies by which the dipper stick receptacle and the curl cylinder receptacle of a backhoe machine can be attached thereto. The receptacles receive a medial length of the upper and lower pins in journaled relation therewithin. The width of the bushing and the diameter of the pin is selected to enable any one of several different buckets to be properly attached to any one of several different compatible sized backhoe machine.

The digging bucket is provided with spaced ears which outwardly extend from the rear of the bucket in opposition to the digging teeth. Spaced apertures formed in each of the ears removably receive a bushing therewithin. The apertures are aligned in upper and lower pairs with each pair being aligned along a common axial centerline. The bushings are bored to receive a specific pin diameter therewithin and therefore the spaced bushings and pin assemblies result in spaced pins which lie parallel to one another and to the horizontal.

The bushings include a large O.D. portion received against an inner face of the ear so that the width of the bushing can be employed to control the medial length of the pin which is engaged by the receptacle of either the dipper stick or the curl cylinder.

Accordingly, a primary object of this invention is the provision of a method by which one of a plurality of different digging buckets can be attached to one of a plurality of different backhoe machines.

Another object of the present invention is the provision of a lift adapter apparatus by which one of a plurality of buckets can be operatively attached to one of a plurality of different backhoe machines.

A further object of this invention is a method by which a specific digging bucket can be attached to a plurality of different backhoe machines.

A still further object of this invention is a method by which any one of a plurality of different buckets can be attached to a specific backhoe machine.

Among other objects of this invention is the provision of lift apparatus comprising a bushing and pin assembly which can be attached to a digging bucket by which the bucket can be attached to a number of different backhoe machines.

The above objects are attained in accordance with the present invention by the provision of a combination of elements which are fabricated in a manner substantially as described in the above abstract and summary.

These and various other objects and advantages of the invention will become more readily apparent to those skilled in the art upon reading the following detailed description and claims and by referring to the accompanying drawings.

DETAILED DESCRIPTION OF THE PREFERRED EMBODIMENT

Figure 1:
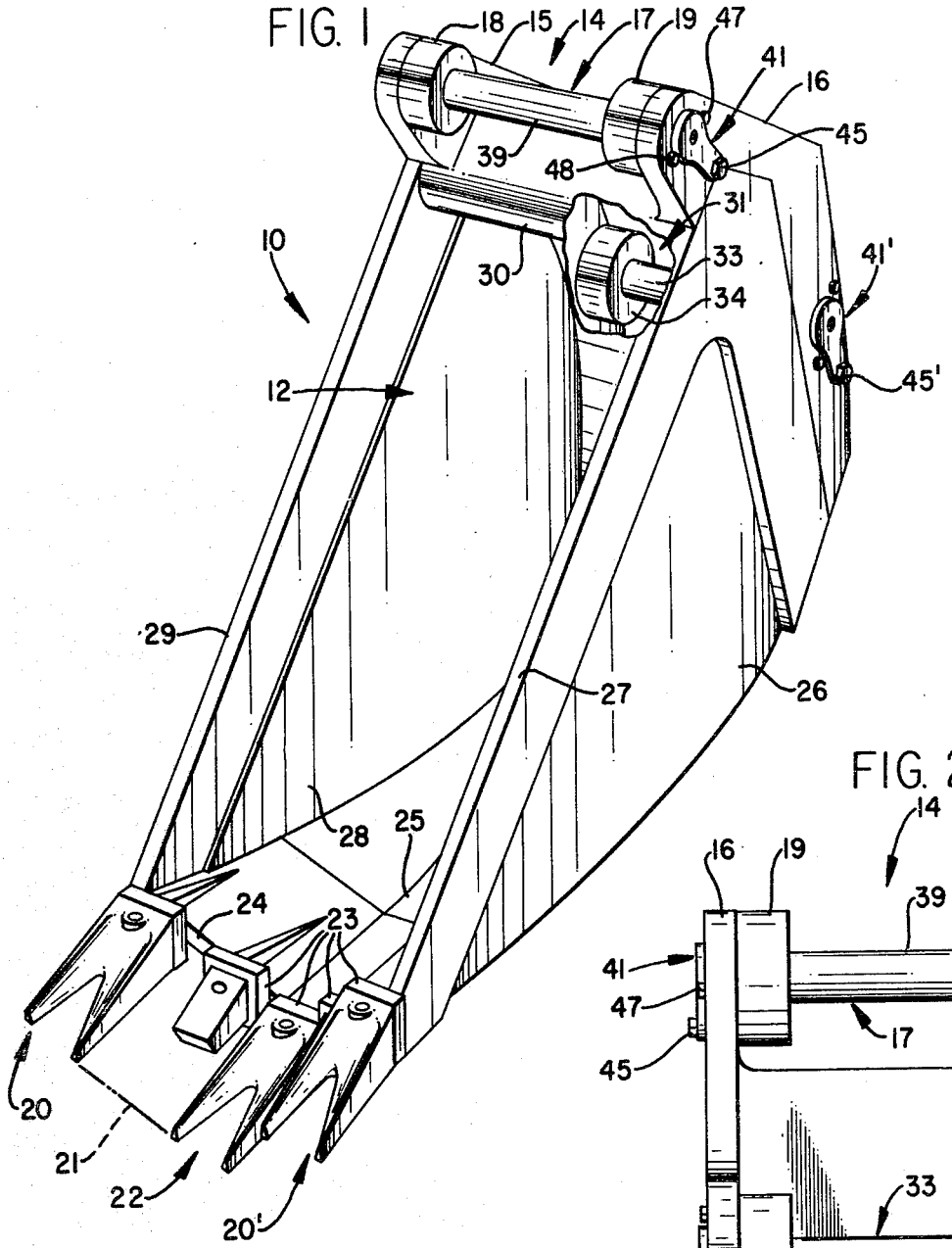
FIG. 1 is a partial front, perspective view of one form of a digging bucket made in accordance with the present invention.

FIG. 1, as well as various other figures of the drawings, discloses an excavating bucket 10 made in accordance with the present invention. The bucket forms an enclosure 12 and is provided with a lift adapter assembly at the trailing end thereof. The lift adapter assembly is comprised of an upper pin and bushing assembly 14 which includes a pair of spaced apart, outwardly directed lifting ears 15 and 16 rigidly affixed to the bucket. A pin 17 has a medial portion thereof exposed between opposed bushings 18 and 19.

The leading edge of the bucket includes a plurality of digging teeth 20, 20' which may be made in accordance with patent application Ser. No. 792,339 filed Apr. 29, 1977, for example. The leading edge of the teeth are aligned along an imaginary V-shaped line 21 with there being a lowermost and rearward most tooth at position 22. The teeth are each removably mounted to a shank 23 and the shank is rigidly affixed to the bucket lip 24. The central tooth at 22 is connected to a centrally located shank which is welded to a keel 25. The keel extends along the bottom of the bucket and curves back up along the rear wall thereof. Sidewall 26 terminates in a forward edge 27 while the opposed sidewall 28 terminates in a similar forward edge portion 29. A rear transverse reinforcement member 30 ties the sidewalls and rearwall of the bucket together. Reference is made to the Hemphill U.S. Pat. No. 4,037,337, issued July 26, 1977, for additional details of construction of the bucket.

Figure 2:
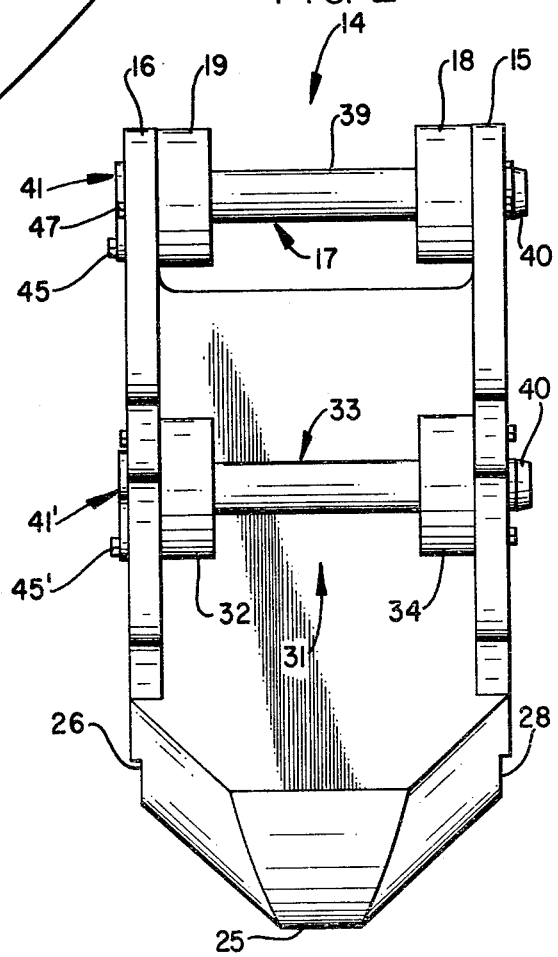
FIG. 2 is a rear view of a digging bucket made in accordance with the present invention.
Figure 3:
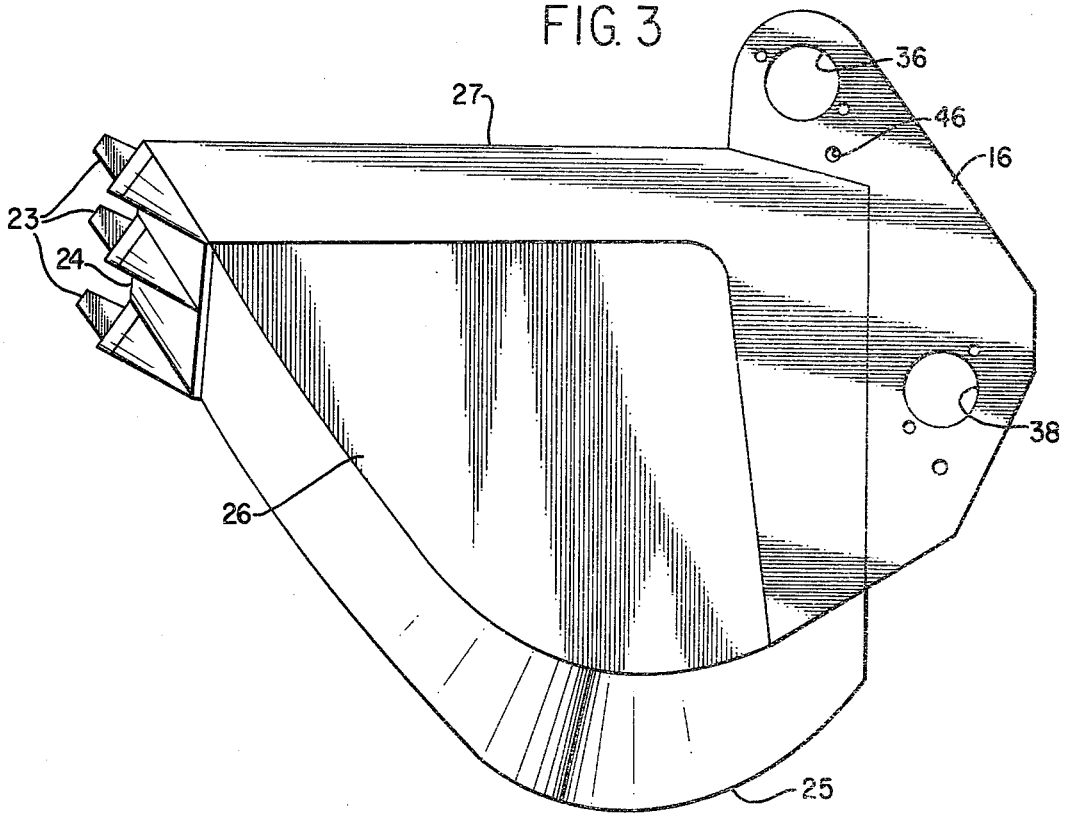
FIG. 3 is a side elevational view of the digging bucket seen in FIG. 2, with some parts thereof being removed therefrom in order to show additional details thereof.
Figure 5:
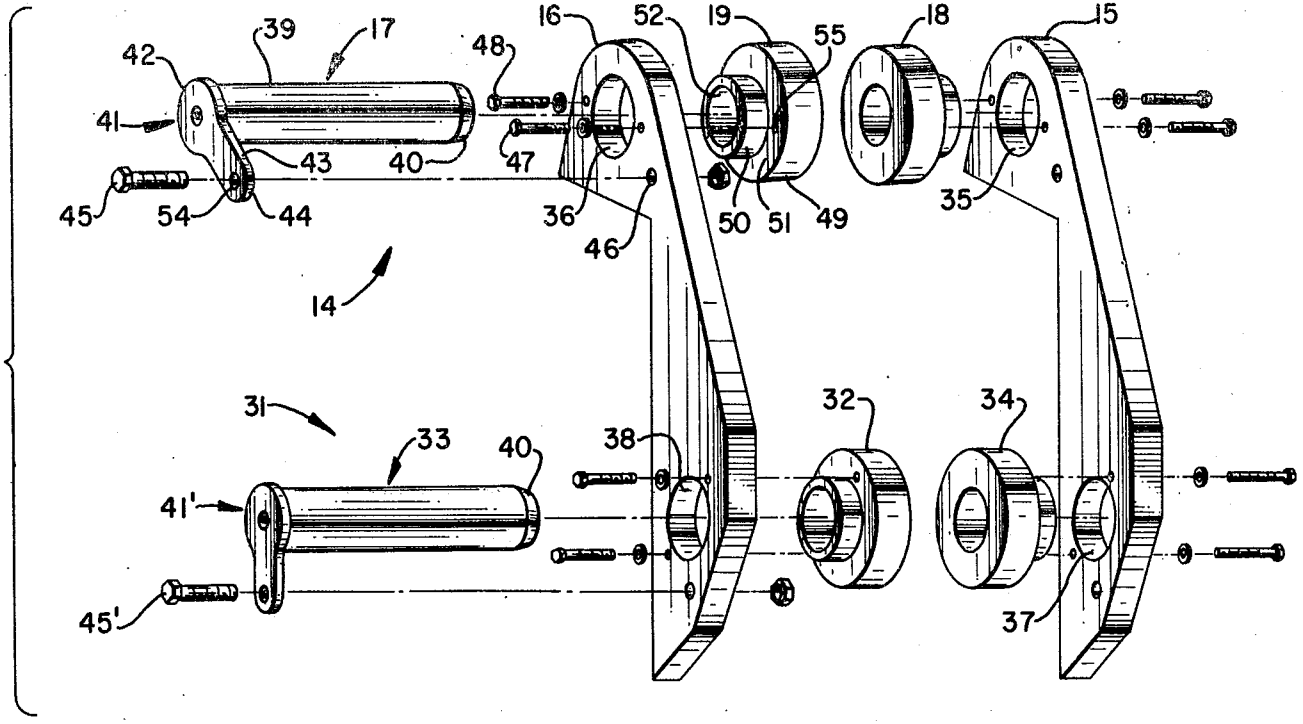
FIG. 5 is an enlarged, exploded view showing some additional details of the bucket previously illustrated in the foregoing figures.

A lower pin and bushing assembly 31, as best seen in FIGS. 1, 2 and 5, is spaced from the beforementioned upper pin and bushing assembly and includes a pair of bushings, one of which is seen at 32. The bushing is removably affixed to the lifting ear 16 and slidably receives a marginal end of pin 33 in close tolerance relationship as will be explained in greater detail later on in this disclosure.

As best seen in FIGS. 2-6, the lower pin and bushing assembly includes an opposed bushing 34 which receives the other marginal end of the pin 33 therewithin. The two lifting ears are apertured as indicated at 35, 36, 37, and 38, with the apertures 35 and 36 being axially aligned respective to one another while apertures 37 and 38 are axially aligned and spaced from one another and from the first recited apertures, with the axial centerline of the upper and lower apertures being disposed in spaced parallel relationship respective to one another.

Pin 17 includes a cylindrical elongated pin body 39 and includes a tapered end 40 which facilitates alignment thereof when the pin is telescopingly forced into place within its two coacting bushings. The opposed end of the pin includes a keeper 41 laterally aligned respective of the longitudinal centerline of the pin, with there being a circumferentially extending enlargement 42 having an outside diameter considerably larger than the outside diameter of the pin, and with the enlargement extending radially outwardly at 43 to form a tongue. The tongue terminates at 44 and is provided with the illustrated bolt hole formed therein through which a fastener means 45 is removably received.

Bolt hole 46 is formed through lifting ear 16 in spaced relation to the aperture 36 and in aligned relationship respective to the bolt hole at 44 so that the beforementioned fastener means 45 can be placed through the apertures at 44 and 46, thereby securing the pin keeper tongue against rotational or longitudinal movement.

Pin 33 and the area adjacent to aperture 38 is similarly provided with a keeper and bolthole so that the pin of the lower attachment assembly can also be secured to the lifting ear in a similar manner.

Fasteners 47 and 48 are received through the drilled holes provided in the ear and are threadedly received in opposed marginal edges of bushing flange 49. As best seen illustrated in conjunction with FIGS. 5 and 6, each of the bushings are reduced in diameter to form a thimble 50. An annular face 51, in the form of a shoulder, is laterally disposed between the large outside diameter of flange 49 and the small outside diameter of thimble 50. The bushing is provided with an inside diameter 52 which receives an appropriate pin in close tolerance relationship. The bushing 18 is identical in construction and of the same size as bushing 19, while the pair of bushings 32 and 34 are identical to one another and similar in construction to the before described bushing, although the lower pair of bushings 32 and 34 often are of different physical size as compared to the upper pair of bushings.

Figure 6:
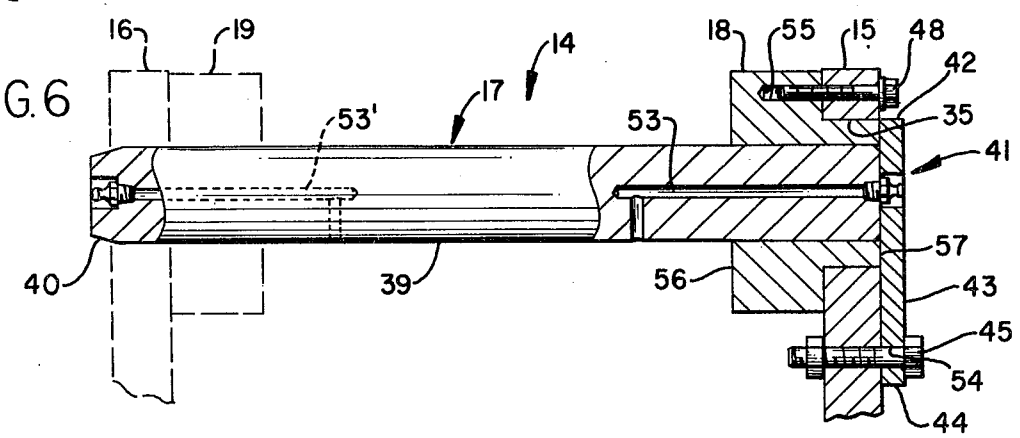
FIG. 6 is a cross-sectional, enlarged, detailed view of part of the apparatus disclosed in some of the foregoing figures.

As best seen illustrated in FIG. 6, the pin is provided with passageways 53 and 53', with the outer extremities thereof terminating in a grease fitting to facilitate lubrication of the pin and receptacle.

Figure 4:
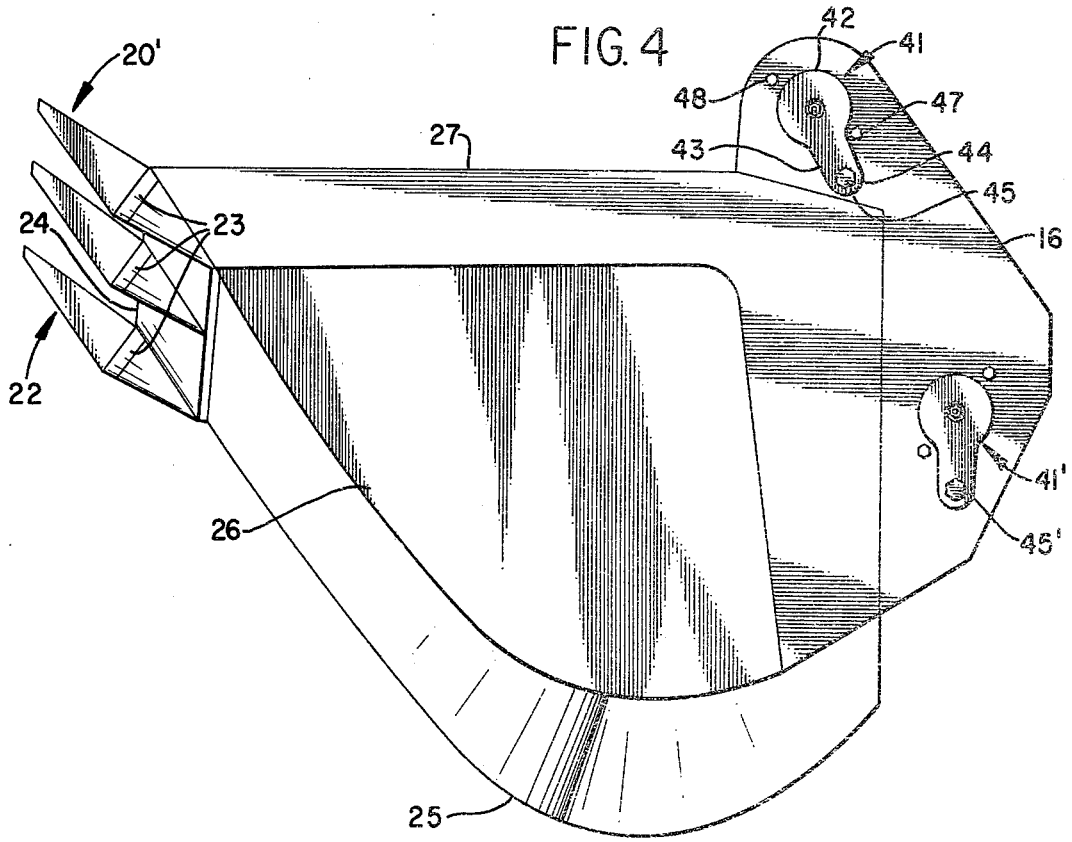
FIG. 4 is a side elevational view of the digging bucket previously illustrated in FIG. 2.

In FIGS. 4, 5, and 6 the details of the pin keeper are more clearly shown. The keeper preferably is rigidly welded to a marginal terminal end of the pin. The keeper tongue is of sufficient length so that the fastener placed through the boltholes 54 and 46 formed in the tongue and lifting ear secures the pin against rotational movement as well as movement along the longitudinal central axis thereof.

The details of the bushings are more clearly set forth in FIGS. 5 and 6 wherein there is disclosed opposed drilled passageways 55 which preferably are threaded. After the thimble of the bushing has been mounted within the aperture 36 of the lifting ear, for example, the fasteners 47 and 48 are extended through the opposed bolt holes located on either side of the aperture 36 and into engagement with the threaded holes 55 formed in the bushing flange.

The inside face 56 of the bushing is opposed to an outside face 57. The inside face 56 bears against the receptacle of the dipper stick while the outside face 57 preferably is aligned essentially in the same plane as the outermost face of the lifting ear.

Figure 7:
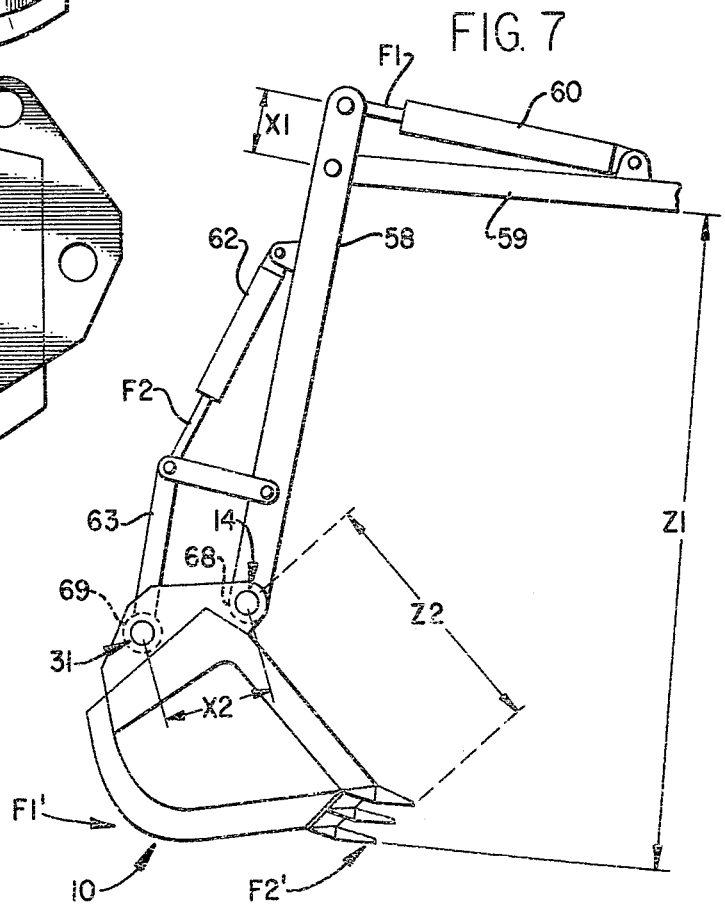
FIG. 7 is a fragmentary, part diagrammatical, part schematical illustration of a backhoe machine and excavating bucket made in accordance with the present invention; and, FIG. 8 is a diagrammatical illustration which discloses some important aspects of the present invention.

In FIG. 7, a dipper stick 58 is journaled to a backhoe boom 59. A hydraulically actuated cylinder and piston assembly 60 is journaled to the pivoted terminal end of the dipper stick so that hydraulic power fluid forces the piston within the cylinder to exert a force $F_1$ along a distance $X_1$, thereby moving the dipper stick in a pivotal manner with a force $F_1'$. That is: $(F_1)(X_1) = (F_1')(Z_1)$.

Hydraulic cylinder and piston assembly 62 is connected between the dipper stick and curl linkage 63 so that hydraulic power fluid forces the piston within the cylinder 62 to exert a force $F_2$ thereby curling the bucket with force $F_2'$. That is: $(F_2)(X_2) = (F_2')(Z_2)$.

Figure 8:
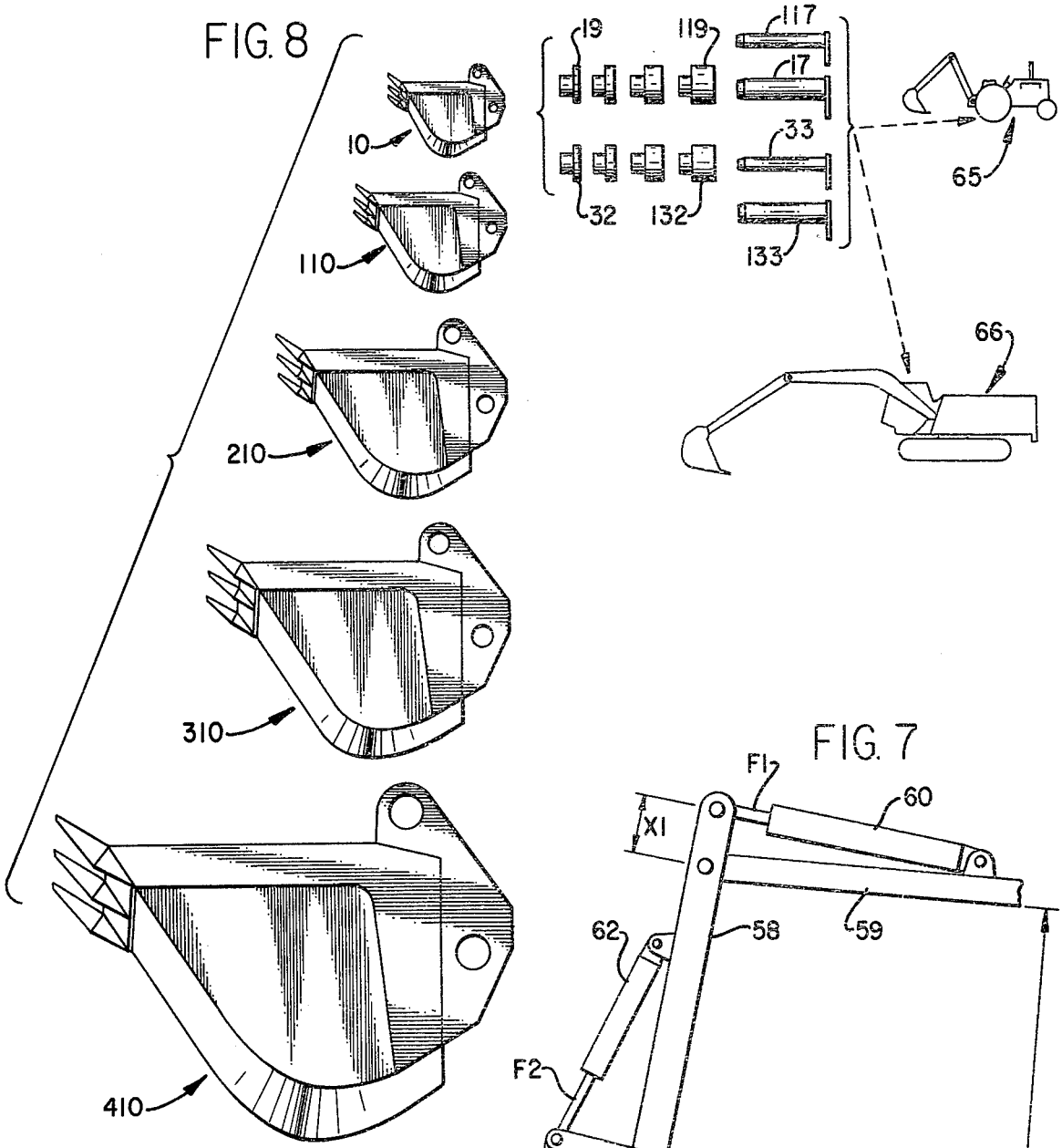

FIG. 8 discloses a plurality of different size buckets 10, 110, 210, 310, and 410, a plurality of different size upper bushings 19-119, and a plurality of lower bushings 32-132. The bushings are arranged in pairs and are of a size and configuration whereby varying different spaced distances between the bushing faces is realized when fitted into the ears of one of the illustrated buckets.

A relatively small backhoe machine 65 can be mated with any one of several relatively small buckets 10 or 110 by selecting the proper pin and bushing assembly for the dipper stick and curl cylinder receptacle. In a similar manner a relatively large backhoe machine 66 can be compatibly mated with any one of several relatively large buckets 310 or 410 by selecting the proper size bushing and pin assembly so that the dipper stick and curl cylinder receptacle properly mates with the lifting attachments formed on the bucket. Various different intermediate size backhoe machines can likewise be fitted with various different size buckets 110, 210, and 310 by similarly selecting an appropriate pin and bushing assembly therefor.

OPERATION

As previously mentioned, the manufacturers of backhoe machines market many different sizes or models of backhoes. The dipper stick receptacle 68 (FIG. 7) often differs from the curl cylinder receptacle 69. That is, on a specific model backhoe the width of the upper receptacle 68 may differ from the width or diameter of the lower receptacle 69 and this is especially so when comparing one manufacturer's model to another, and almost invariably so when comparing one manufacturer's backhoe to another manufacturer's backhoe.

Most manufacturers market their own bucket which naturally is fabricated specifically for one model of the manufacturer's machine. Accordingly, one usually cannot readily attach one manufacturer's bucket onto a different manufacturer's backhoe machine and this obstacle presents a major difficulty heretofore not overcome with excavating equipment.

As seen in FIG. 7, a backhoe machine provides a force $F_1$ by which the bucket is forced horizontally along the ground as the teeth engage and excavate material therefrom. As the bucket is forced along the ground at $F_1'$, force $F_2$ continually uncurls the bucket thereby providing force $F_2'$ for maintaining the teeth properly positioned respective to the excavation being formed by the equipment. Accordingly, it is desirable that $F_1'$ be equal to $F_2'$, and further that the weight of the machine as well as the capacity and bucket design all be within a range which is compatible with one another.

Since the usual buckets weigh anywhere between 350 and 9,000 pounds and hold anywhere between one-half and eight yards of material, while the machines weigh anywhere between 14,000 and 258,000 pounds, it follows that there is an optimum size and bucket design which can be selected for any specific machine. Therefore, where a contractor operates several different backhoe machines of varying size, it is advantageous to be able to attach a plurality of different buckets to any one of the plurality of backhoe machines in accordance with the foregoing disclosed invention.

As an example, assume that the owner of a John Deere backhoe machine contemplates the purchase of a Hemphill bucket as seen illustrated in FIGS. 1-4. The owner informs the Supplier of the make and model of his backhoe machine and the type excavating he generally undertakes, thereby enabling the Supplier's sales engineer to select the optimum size and design bucket 10-410 of FIG. 8. This selection is made in accordance with the available force $F_1'$ and $F_2'$ of FIG. 7 which can be calculated by referring to the manufacturer's technical catalogues. This enables the optimum size bucket to be selected for the contractor. The bucket is fitted to the receptacles of the John Deere backhoe machine by selecting the proper upper and lower adapter bushing and pin assembly to provide the exact desired configuration of pivot points at 14 and 31.

At some subsequent time, should the John Deere backhoe machine become inoperative and consequently sent to the shop for repairs, the contractor need not lose any substantial amount of time because he can readily substitute any local backhoe machine comparable in size to his inoperative John Deere machine by selectively employing a different set of upper and lower adapter bushing and pin assemblies in order to adapt his Hemphill bucket to the substitute backhoe.

As another example, assume a contractor owns three different size backhoe machines, namely, a Catapillar model 225, 235, and 245. The machines were each purchased along with a prior art bucket. Subsequently, following purchase of the machines, the contractor encounters difficulty in digging rock and decides to purchase two additional Hemphill buckets for use in conjunction with the three machines. A Hemphill bucket size #30 and #50 is selected for the Catapillar model 225 and 245 machine. The model 225 backhoe is fitted with adapter pins and bushings for the Hemphill model #30 bucket; the model #245 backhoe is fitted with adapter pins and bushings for the Hemphill model #50 bucket, while the model 235 backhoe is fitted with two sets of adapter pins and bushings which enables the backhoe to be fitted to either of the buckets. Hence, by selectively utilizing the Hemphill adapter pin and bushing assemblies, it is possible to fit a plurality of buckets to any one of a plurality of machines, and vice versa, thereby further effecting a financial savings.

The actual measurements of the adapter pins and bushings are as follows:

| | Model 225 | Model 235 | Model 245 |
|---|---|---|---|
| Pin length | 22 inch | 22" | 26½" |
| Pin diameter | 3 inch | 3½" | 3½" | 5" |
| Bushing inside diameter | 3 inch | 3½" | 3½" | 5" |
| Bushing outside diameter | 8 inch | 8" | 9" | 9" |
| Thimble outside diameter | 5 inch | 5' | 6" | 6" |

-continued

| | Model 225 | Model 235 | | Model 245 |
|---|---|---|---|---|
| Bushing width | 5⅜ inch | 3⅜" | 5⅝" | 5¼" |
| Thimble width | 2 inch | 2" | 2" | |
| Bucket | #30 | #30 or #50 | | #50 |

I claim:

1. In a backhoe machine of the type having a dipper stick attachable to a digging bucket by an upper receptacle located on the end of the dipper stick and spaced from a lower receptacle which is actuated by a curling cylinder, the improvement comprising:

said bucket having spaced lifting ears rigidly affixed to a rear wall thereof, upper and lower apertures formed in said ears with the uppermost apertures being axially aligned with one another and the lowermost apertures being axially aligned with one another, thereby providing an upper and a lower pair of apertures;

a bushing having a thimble and a flange, with the thimble having an outside diameter of a size to be removably received in close tolerance relationship within each said aperture, with the flange thereof abutting the inner face of said ear so that the flanges of said upper pair of bushings and the flanges of said lower pair of bushings are opposed to one another and abuttingly received against adjacent opposed faces of the ears;

an axial hole formed through each said bushing, a lifting pin received by said upper bushings thereby leaving a medial length of said pin by which said upper receptacle is pivotally affixed to said bucket;

a lifting pin received by said lower bushings thereby leaving a medial length of said pin by which said lower receptacle is affixed to said bucket;

whereby said bucket is attached to said dipper stick by a medial length of said upper and lower pins, and said upper and lower pins can be removed from said bushings and said receptacle to thereby remove the bucket from the dipper stick.

2. An excavating bucket having a plurality of digging teeth at the forward end thereof and spaced lifting ears at the trailing end thereof by which said bucket is attached to a backhoe machine;

upper and lower spaced apart apertures formed in each of said ears with the upper pair of apertures being axially aligned with one another and the lower pair of apertures being axially aligned with one another;

a bushing having a marginal portion thereof removably received within each said aperture; the upper pair of bushings extending towards one another and the lower pair of bushings extending towards one another and effectively reducing the spaced distance between spaced ears;

an axial bore formed along a common axial centerline through said upper and said lower pair of bushings thereby forming spaced axial bores;

a pin removably received through the axial bore of said upper pair of bushings and said lower pair of bushings, and means by which said pin is removably secured within said bushings so that the upper and lower pin of said upper and lower pairs of bushings can receive a stick and curl receptacle of a backhoe machine;

each of said bushings include a thimble and an enlargement with an annular shoulder formed therebetween;

said thimble is said marginal portion of said bushings which is recited as being received within said aperture; said annular shoulder is abuttingly received against the facing surface of said ears;

thereby leaving said enlargements of a pair of bushings interposed between a receptacle and the ears.

3. The bucket of claim 2 wherein said thimble of said bushing is of a width substantially the same as the width of the lifting ears, and said bushings include a fastener means by which they are removably affixed to said ears.

4. An excavating bucket having a plurality of digging teeth at the forward end thereof and spaced lifting ears at the trailing end thereof by which said bucket is attached to a backhoe machine;

upper and lower spaced apart apertures formed in each of said ears with the upper pair of apertures being axially aligned with one another and the lower pair of apertures being axially aligned with one another;

a bushing having a marginal portion thereof removably received within each said aperture; the upper pair of bushings extending towards one another and the lower pair of bushings extending towards one another and effectively reducing the spaced distance between spaced ears;

an axial bore formed along a common axial centerline through said upper and said lower pairs of bushings thereby forming spaced axial bores;

a pin removably received through the axial bore of said upper pair of bushings and lower pair of bushings, and means by which said pin is removably secured within said bushings so that the upper and lower pin of said upper and lower pairs of bushings can receive a stick and curl receptacle of a backhoe machine;

said pin includes means by which a keeper is affixed to one end thereof, said keeper includes a plate member arranged normally respective to the central axis of the pin;

and a fastener means by which the plate member is affixed to an outside face of an ear.

5. In a backhoe machine of the type having a dipper stick attachable to a digging bucket by an upper receptacle located on the end of the dipper stick in spaced relationship to a lower receptacle associated therewith which is actuated by a curling cylinder, and wherein the bucket includes spaced lifting ears rigidly affixed to and extending from a rear wall thereof, the improvement comprising;

an adapter bushing and pin apparatus by which any one of a number of different buckets can be attached to the upper and lower receptacle of the dipper stick;

upper and lower apertures formed in the ears with the uppermost apertures being axially aligned with one another and the lowermost apertures being axially aligned with one another, thereby providing an upper and a lower pair of axially aligned apertures;

said adapter bushing and pin apparatus includes upper and lower pairs of bushings, a marginal portion of said upper and lower pairs of bushings, respectively, having an outside diameter of a size to be received within said upper and lower pairs of apertures, respectively;

means mounting said bushing within said apertures such that adjacent ends of each pair of bushings are spaced apart an amount to receive the appropriate receptacle therebetween;

an axial hole formed through each said bushing, a lifting pin received through said axial hole of said upper pair of bushings, thereby leaving a medial length of said pin by which the upper receptacle is pivotally affixed to said bucket;

a lifting pin received through said axial hole of said lower pair of bushings, thereby leaving a medial length of the last said pin by which the lower receptacle is affixed to said bucket; means by which each of said lifting pins and each of said bushings are fastened relative to said ears to prevent longitudinal movement thereof; whereby, said bucket can be attached to said dipper stick by a medial length of said upper and lower pins, and said upper and lower pins can be removed from said bushings and said receptacle to thereby remove the bucket from the dipper stick.

* * * * *